US005713400A

United States Patent [19]

Wells et al.

[11] Patent Number: 5,713,400

[45] Date of Patent: Feb. 3, 1998

[54] COIL SPRING INTERIOR ASSEMBLY METHOD AND APPARATUS

[75] Inventors: Thomas J. Wells; Ronald E. Coffey, both of Carthage, Mo.

[73] Assignee: L&P Property Management Company, Chicago, Ill.

[21] Appl. No.: 535,309

[22] Filed: Sep. 27, 1995

[51] Int. Cl.[6] ..... B21F 27/00; B21F 33/00

[52] U.S. Cl. ..... 140/3 CA; 140/108

[58] Field of Search ..... 140/3 CA, 89, 140/92.4, 92.7, 107, 108

[56] References Cited

U.S. PATENT DOCUMENTS 4,886,249 12/1989 Docker et al. .
5,139,054 8/1992 Long et al. .

FOREIGN PATENT DOCUMENTS 1095980 12/1967 United Kingdom .
1522611 8/1978 United Kingdom .

*Primary Examiner*—P. W. Echols
*Attorney, Agent, or Firm*—Wood, Herron & Evans, L.L.P.

[57] ABSTRACT

A spring interior assembly method and apparatus produces spring interiors formed of a plurality of longitudinally connected columns of spring coils. Preferably, the spring interiors are formed as continuous wire bands each of alternating coils and bridging sections. Corresponding, coils of each column are laced together with transverse lacing wires as the columns are indexed longitudinally through a lacing station and are adjusted to correct lengths as the spring interiors are assembled. A measurement device or other form of sensor at a measurement station downstream of the lacing station in the assembly machine signals the length of a portion of the spring interior, preferably including a number of bridging sections. A processor in the assembly machine controller causes the last laced section to be longitudinally deformed to adjust its length in response to the measurement. Preferably, a plurality of measurements and the adjustments are stored and analyzed by the processor which adjusts the correction response based on the analysis. The adjustment may be made to only stretch the interconnected columns of coils, and do so by only a fixed amount, when the measured length is shorter than a predetermined minimum, with no adjustment being otherwise made.

19 Claims, 5 Drawing Sheets

COIL SPRING INTERIOR ASSEMBLY METHOD AND APPARATUS

The present invention relates to the formation and assembly of coil spring interiors of the type used in the manufacture of mattresses and the like, and particularly to the control of spring interior dimensions in the process of assembling of spring interiors in the form of arrays of interconnected coils, and particularly of transversely-interlaced, longitudinally-extending, continuous, multiple-coil bands.

BACKGROUND OF THE INVENTION

Spring interiors are formed of arrays of wire coils that are interconnected both transversely and longitudinally by other wire elements. The formation of the wire elements that join the coils develop dimensional errors during assembly or due to material variations or tolerances in the spring coil band forming process. Unless corrected, cumulative error develops along the length of the spring interior that is assembled, which can result in an unacceptable error in the ultimate length of the spring interior unit from that required for the manufacture of a standard size mattress. Correction of such errors has been achieved in the past by compressing or stretching the spring assembly, in a longitudinal direction for example, after the spring interior has been at least partially assembled.

One method of forming spring interiors has been to feed a plurality of continuous bands each formed of a series of alternating coils, each interconnected by a formed bridging section, and each formed of a continuous wire, side-by-side into an assembling apparatus. In the apparatus, the bands are joined by transverse lacing coils, usually one for each row of coils. The longitudinal spacing between each of the lacing coils is typically of a predetermined fixed design length. Frequently, however, this distance deviates from the desired design length due to an accumulation of tolerances in the band forming or the assembly process, sometimes due to variations in the properties of which the material from which the springs are formed is made, that results in deviations from the intended spring interior dimensions after assembly, particularly in the longitudinal direction. Accumulation of such errors causes the cumulative error that results in an overall deviation from the desired length of the spring interior to be formed.

Another method of forming spring interiors involves the lacing of individual discrete spring coils arranged in rows and columns in an array. The coils are transversely laced, as the continuous bands are laced, to connect transversely spaced coils of each row together. However, rather than being connected to the longitudinally adjacent coils by bridging sections of a continuous wire of which the longitudinally adjacent coils are formed, the lacing wires wrap around the wires of the heads of the longitudinally adjacent coils to interconnect them in the longitudinal direction. Other methods may interconnect coils by other schemes. In any event, errors in length similar to the types described above result, and should be corrected if the quality of the resulting spring interior product is to be achieved.

Deviations in the length of the spring interiors, due to the cumulative error in the formation or assembly of the springs, either reduce the quality of the spring interior product of increasing the cost of the spring interior or final mattress product as a result of time and labor required to correct the dimensional error by manipulation of the assembled spring interior product. Accordingly, a need exists in the art of spring interior manufacture to eliminate dimensional errors in the spring interior assembly process, so that, when the assembly is completed, the assembled product conforms to the desired dimensional requirements. Further, it is desirable that such a need be filled without providing an additional step or machine in the spring interior assembly process or manufacturing line, and without consuming additional production time.

SUMMARY OF THE INVENTION

A primary objective of the present invention is to improve the dimensional tolerances of assembled spring interiors. A more particular objective of the present invention is to provide a method and apparatus in which errors in length along portions of spring interior assemblies be determined as the spring interiors are being formed, so that dimensional correction can be provided in the assembled product.

It is a further objective of the present invention to provide a system and method for forming spring interiors that has the capacity for automatically sensing dimensional errors in the spring interior length being formed and for automatically correcting the errors by adjusting the length of at least a portion of the interior, in response to the sensed error, during the spring interior assembly. It is a more particular objective of the present invention to provide a computer controlled spring interior assembly method and apparatus that provides for the measurement of errors in the lengths of spring interiors being formed and corrects or adjusts the length of the remainder of the spring interior to be formed by an amount based on the measurement. It is still a further objective of the present invention to provide an automatic spring interior length adjusting method and apparatus that adjusts the amount of automatic corrective action based on the response to previous measurements and the corresponding corrective action required.

In accordance with principles of the present invention there is provided a spring interior assembly method and apparatus in which at least a portion of a length of a spring interior being formed is sensed or measured, and the length of at least a portion of the spring interior being formed is determined or automatically adjusted based on the result of the sensing or measurement. One preferred embodiment of the present invention provides a presence detector at a fixed position downstream from a lacing station a distance that is equal to the desired spacing between lacing springs in a given plane of the spring interior multiplied by a predetermined number, for example five. In such a case, the sensor detects if the total length of the spring assembly is less than the desired length of a predetermined number of such spacings. If it is not less than the desired length, then the sensor signals a binary bit of information, indicating that the spacing between the last to be laced lacing coils need not be stretched. If the length is less than the desired length for the predetermined number of sections, then the sensor sends a signal indicating that the springs must be stretched, whereupon a set of dies grip the spring assembly at the intersection of each spring band of longitudinal column of springs of the array with each of the last two lacing coils installed and move the lacing coils apart a fixed predetermined distance, thereby stretching each of the coil bands or columns by the same amount at the same adjacent section. The decision as to whether or not to stretch a section is thereby made in such a way as to maintain any length of the spring assembly to within a given tolerance. In such an embodiment, the fixed length of the stretch stroke can be manually adjustable. In a version of this embodiment, the longitudinal columns of springs are either stretched or compressed in response to a multi-bit signal from the sensor that indicates that the bands are too long, too short, or within tolerance.

In another embodiment of the invention, there is provided a sensor that returns a value to a computer control indicating the actual measured length of the portion of the spring interior, or indicating an amount by which the length is longer or shorter than the desired length. Based on such amount or other length measurement, the computer determines whether or not the length is to be changed by stretching the columns of coils, by compressing them, or by either stretching or compressing them. The system may, according to this embodiment, be provided with a variable stroke device that stretches or compresses the columns in response to the magnitude of the error between the sensed length and the desired length. Further, there may be provided programming in the controller that analyzes a series of length measurements as well the corrections that have been made, and then adjust the fixed length of the stretching stroke to an optimum length to cause the error to be eliminated most efficiently. Such an analysis accommodates variations in spring material properties that affect the relative amounts of plastic and elastic deformation in the longitudinal direction.

The sensor or measurement device may be any of a number of available or yet to be developed devices, such as a simple limit switch, magnetic switch, photo-sensitive switch or other binary output device, or may be a laser presence detector or length measuring system, a three dimensional video imaging system, or any other type of measuring or sensing device that develops information from the spring interior being formed as to the length of the spring interior or any portion thereof.

With the present invention, the dimensional tolerances of spring interior products is improved while the need for additional length correcting steps that add time to the spring interior assembly process is avoided. Accordingly, an improved spring interior product results and an assembly process is provided that is economical and efficient.

The present invention is most effective in maintaining the desired lengths of spring interiors in the longitudinal direction where the longitudinal columns of springs in the spring interior spring array are formed of continuous bands of coils that alternate with bridging sections formed along a continuous wire. The invention also has use, however, in correcting dimensions, particularly longitudinally, of spring interiors formed of arrays of discrete spring coils that are laced together both in transverse rows and longitudinal columns or otherwise joined in two dimensions.

These and other objectives and advantages of the present invention will be more readily apparent from the following detailed description of the drawings and preferred embodiments, in which:

DETAILED DESCRIPTION OF THE PREFERRED EMBODIMENTS

Figure 1:
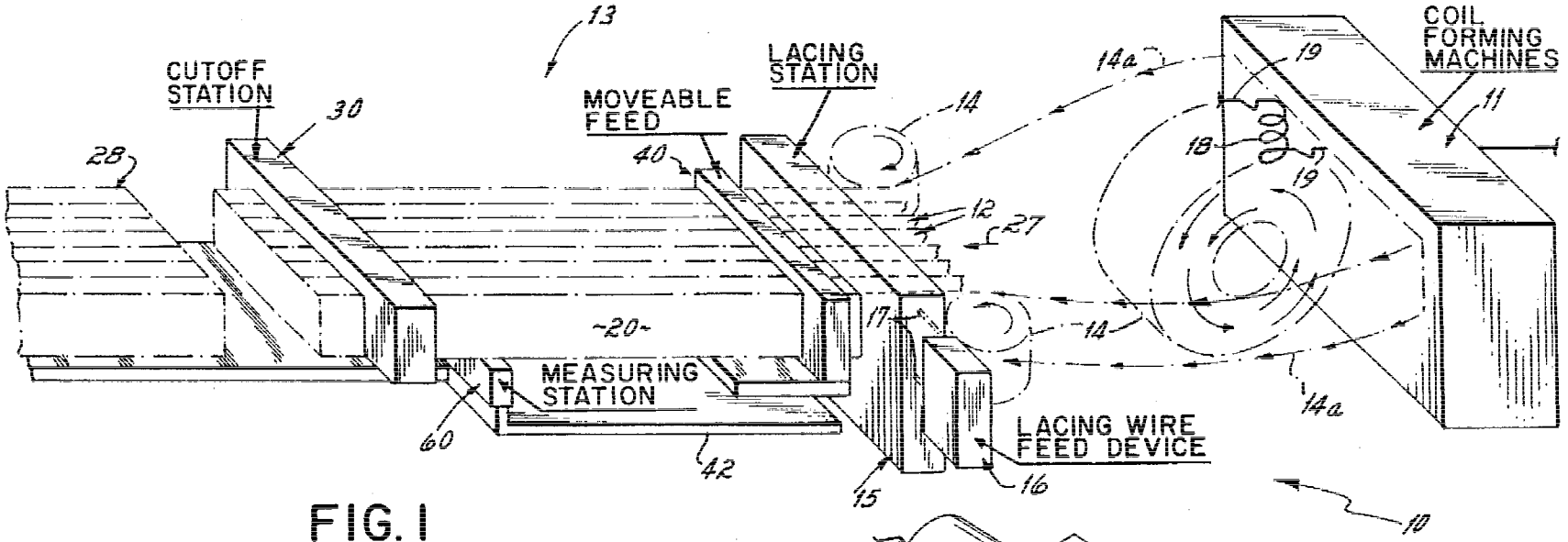
FIG. 1 is a perspective diagram illustrating the preferred layout of the stations of a spring interior assembly process according to one preferred embodiment of the present invention.

Referring to FIG. 1, a spring interior forming system 10 includes one or more spring coil band forming machines 11 of one preferred type which produces continuous bands of coil springs 12 to supply a spring interior assembly apparatus 13. Examples of such spring coil band forming machines 11 are those disclosed in British Patent No. 937,644 and U.S. Pat. Nos. 4,112,726 and 5,105,642. Such machines can be set to feed bands directly into the apparatus 13, as indicated by phantom arrow 14*a*, which may require one machine for each band, or, as is more typical, may be operated separate from the assembly apparatus 13 to produce bands that are wound into rolls 14 that are then supplied to the assembly apparatus 13.

The spring assembly apparatus 13 includes a lacing station 15, at which a lacing wire feeding device 16 transversely feeds a coiled lacing wire 17 (FIG. 2) to engage and interconnect the bands 12 join the coil springs thereof into an array. A spring assembly device with such a lacing station is described in U.S. Pat. No. 5,139,054 entitled Spring Interior Forming and Assembling Apparatus, expressly incorporated herein by reference, which also describes the configuration of bands 12. For purposes of the present description, it is sufficient to consider the configuration of the bands 12 to include alternating coil springs 18 and bridging sections 19 formed in the continuous wire of each of the bands 12, as diagrammatically illustrated in FIGS. 2 and 3. The bridging sections 19 alternately lie in the top and bottom planar surfaces of spring interiors 20, in which planes the junctions of the ends of adjacent bridging sections and coils of each of the bands 12 are interconnected by the lacing wires 17.

Alternative versions of spring forming machines and spring interior assembly machines that employ discrete coils that are laced in two dimensions in an array of longitudinal columns and transverse rows utilize equipment such as disclosed in U.S. Pat. No. 3,386,561 to Spühl and U.S. Pat. No. 3,774,652 to Strum. Other machines that form, handle or assemble such springs in spring interiors are disclosed in U.S. Pat. No. 4,413,659 to Zängerle and U.S. Pat. Nos. 4,625,349 and 4,705,079 to Higgins, all hereby expressly incorporated by reference herein. The principles of the present invention are described herein in the context of the preferred embodiment in which the longitudinal columns of coils of the arrays of coils that form the spring interiors are interconnected by bridging sections that are formed of the same continuous wires as are the longitudinally adjacent coils.

Referring again to FIGS. 2 and 3, the lacing of the bands 12 with the lacing wires 17 is carried out with one upper and one lower lacing wire being simultaneously laced at the lacing station 15, and longitudinally offset by one-half of the nominal length B of a bridging section 19 (FIG. 3). At the lacing station 15 there are provided two sets of dies, including an upper die set 21 and a lower die set 22. Each of the dies of each set include a stationary die element 23 and a moveable clamping die 24. The fixed die 23 has a tapered upper surface 25 on the upstream side thereof to allow the upper ends of the spring coils 18 of the bands 12 to ride over the fixed clamps 23 as the bands 12 are advanced through the lacing station 15. The moveable dies 24 of each set 21,22 are pivotally mounted to a shaft 26 at the lacing station 15 to swing out of the path of the advancing bands and to swing against the fixed clamp 23 to clamp segments of the wires of the adjacent coils 18 together to hold them in position for lacing. The lacing wire is fed by rotating it in the direction of the pitched coils thereof to screw the lacing wire 17 around the wires of the coils 18, which is conventional.

Figure 2:
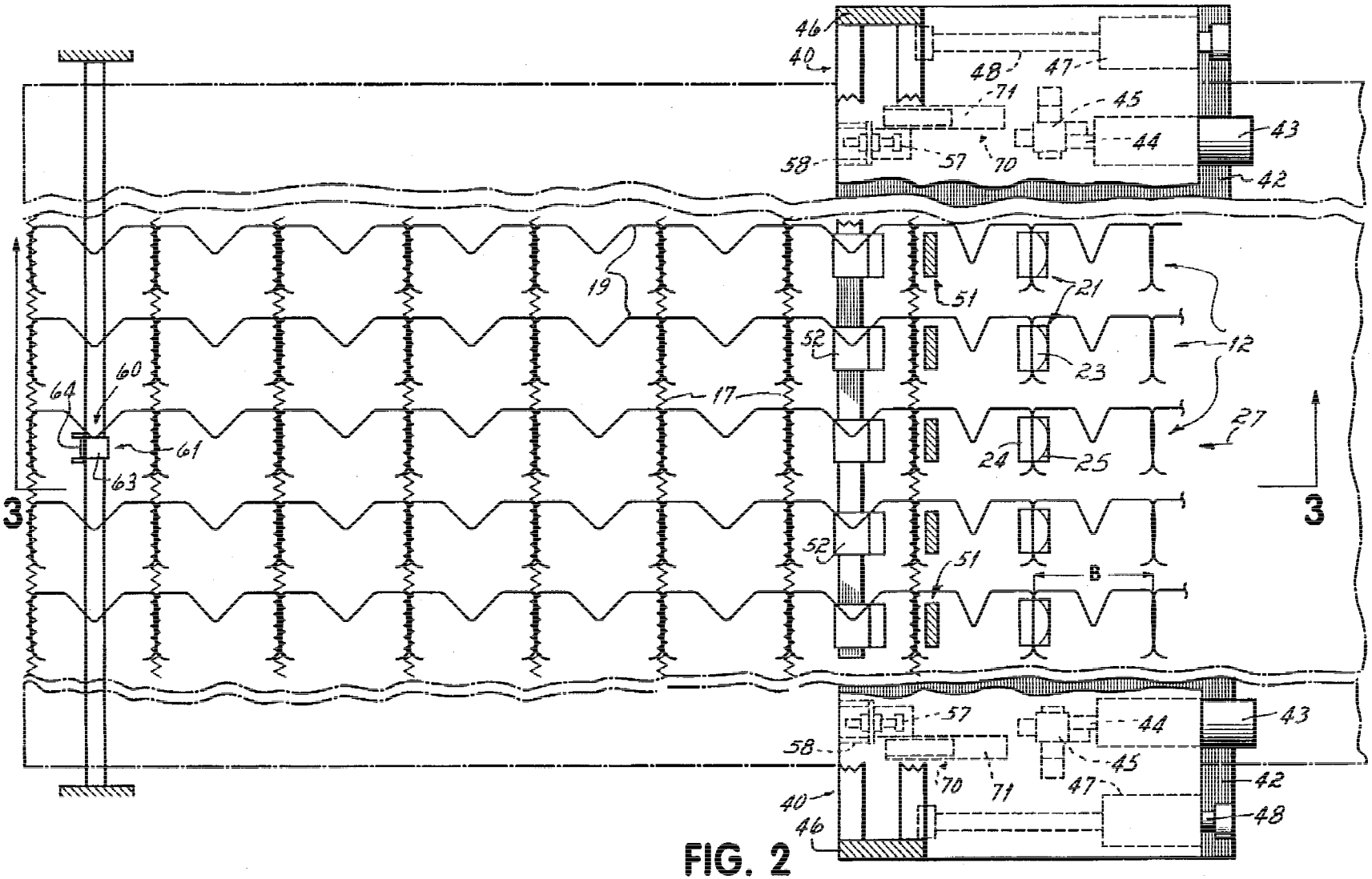
FIG. 2 is a top plan view of the embodiment of FIG. 1 illustrating the lacing, length adjusting and measuring stations of the assembly apparatus.
Figure 3:
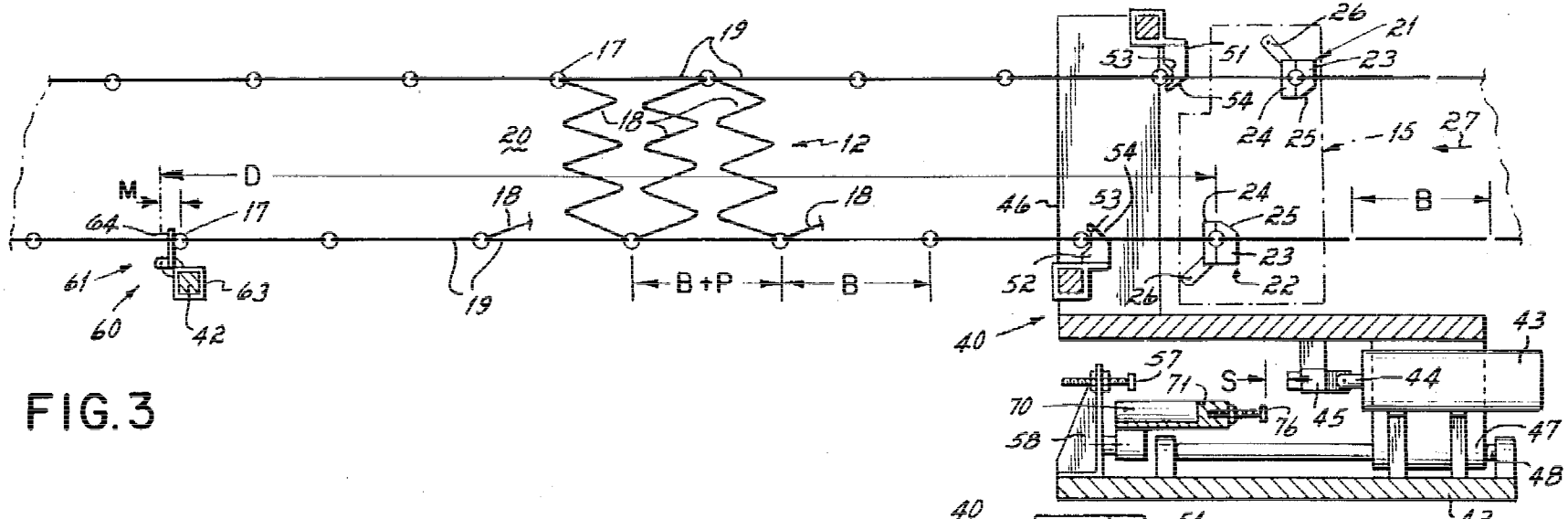
FIG. 3 is an elevational view of the lacing, adjusting and measuring stations of the apparatus, taken along the line 3—3 of FIG. 2, and showing the measurement condition requiring stretching of the spring interior assembly.

The conventional cycle of operation of a spring assembly apparatus 13 is to simultaneously index the bands 12 in the downstream direction, as illustrated by arrow 27, to the position illustrated in FIGS. 2 and 3, then to lace the upper and lower ends of the coils 18 of the bands respectively together by feeding an upper and a lower lacing wire 17 at the lacing station 15, and then to advance the bands 12 and of the partially formed spring assembly 20 downstream a distance B to bring the bands in position to apply the next pair of lacing wires 17. The bands 12 and the spring assembly 20 are so indexed and formed, cycle by cycle, until the required number of section lengths B are fed past a cutoff station 30 at the downstream end of the spring interior assembly apparatus 13, whereupon the bands are cut to sever a completed spring interior assembly 28 therefrom.

The conventional spring interior assembly apparatus 13 includes an indexing or band advancing mechanism 40 mounted on a stationary frame 42 of the assembly apparatus 13. The mechanism 40 includes a pneumatic cylinder 43, fixed to the frame 42, having an output shaft 44 extending from the piston of the cylinder 43 and linked to a bracket 45 on a moveable feed block or feed element 46. The feed element 46 is slidably mounted via a set of roller bearing assemblies 47 that are mounted to reciprocate on longitudinal rods 48 fixedly secured to the stationary frame 42. The feed block 46 has two transverse rows of feed elements fixed thereto including an upper row of upper feed elements 51 and a row of lower feed elements 52, each positioned to align in a horizontal plane with the lacing wires 17 respectively lying in the top and bottom planar surfaces of the spring interior 20. Each of the feed elements 51,52 has a concave feed surface 53 on the downstream side thereof that is configured to engage, while advancing, a lacing wire 17 to push the entire spring interior 20 and each of the bands 12 downstream by a distance B. Each of the feed elements 51,52 also has a tapered surface 54 on the upstream side thereof to guide the feed element past a spring coil 18 or lacing wire 17 when the element is retracting to return to its upstream position after a feed stroke. The length of the feed stroke B is determined by the setting of a mechanical stop 57 adjustably mounted to a stop support bracket 58 fixed to the frame 42 in the path of the advancing bracket 45, thereby limiting the feed stroke of the cylinder 43. The stop 57, in this embodiment, is manually adjustable, but it may be provided with a servo or stepper motor adjustment by which adjustment can be made by controls on an operator console or may be made under the control of the controller, a computer or other processor after analyzing measurement information, described more fully below.

In customary operation of the feeding mechanism 40 of the spring interior assembly apparatus 13, when it is determined that the spring interior 20 is to be indexed by one section length B, the cylinder 43 feed mechanism 40 is actuated and the moveable clamping dies 24 of both the upper and lower die sets 21,22 are released, so that the lacing wire 17 at the lacing station 15 can be advanced unobstructed away from the fixed dies 23 of the die sets 21,22. After the spring interior 20 has been indexed, the moveable dies 24 close against the fixed dies 23, with wires of adjacent spring coils 18 between them, so that the next lacing wire 17 can be spirally fed to lace the coils together.

Ideally, where the section lengths B being formed consistently equal some predetermined or desired section length, then the cumulative length of any portion of the spring interior being formed that is made up of a given number of sections of the bands will equal some exact multiple of the section length B. For example, as illustrated in FIG. 3, the length of the portion of the spring interior 20 from the lacing station 15 to the seventh lacing wire 17 downstream from the lacing station 15 should ideally equal a distance D that equals 7×B. Therefore, in accordance with the present invention, the spring interior assembly apparatus is provided with a measuring station 60 spaced at a distance D downstream of the lacing station 15, but upstream of the cutting station 30. The measuring station 60 includes a sensor 61 that generates a signal to a controller, computer or other information processor, that represents the actual length of the portion of the spring interior 20 that extends from the upper die set 21 to the seventh lacing wire 17 downstream from the die set 22.

The sensor 61 can take any of a number of forms that measure the length of the spring interior 20 or that sense the position of the point on the spring interior 20, such as the position of a lacing wire 17 relative to some other point on the spring interior 20 or apparatus 13. With the spring interiors being made of steel wire, magnetic sensors are useful, as are other proximity sensors, laser or optical sensors and imaging systems. With the first embodiment herein described, the sensor 61 is a simple mechanical switch 65 which is normally open when a particular lacing wire 17, e.g. the seventh lacing wire 17 from the die set 22, is less than the distance D from the die set 22, and is closed when it is at a distance equal to or greater than the distance D from the die set 22. Accordingly, the sensor 61 will produce a binary signal equal to zero when the spring interior length of the seven sections thereof immediately downstream from the lacing station 15 is at least long enough, and is equal to one when this spring interior length requires stretching. In FIG. 3, the spring interior 20 is illustrated as being short by an amount M less than the distance D needed to actuate the sensor 61, indicating that it be stretched by that amount.

Figure 5:
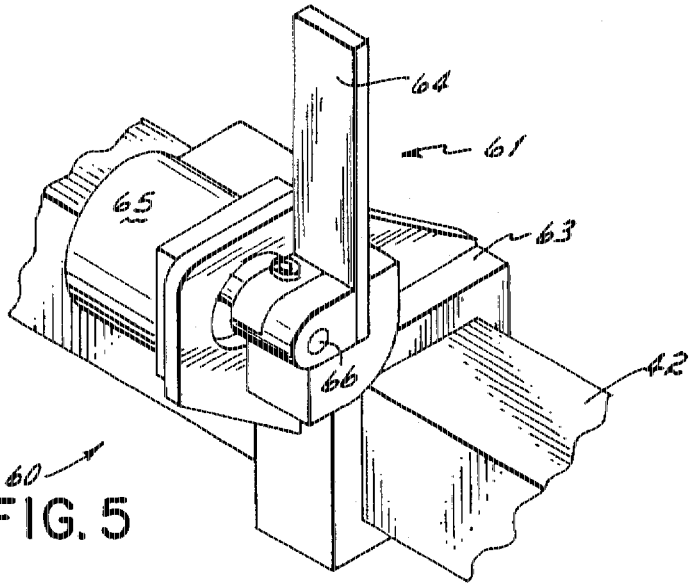
FIG. 5 is an isometric view of a length sensor of the assembly apparatus of FIG. 2 according to one embodiment of the present invention.

Such a sensor 61 of this first embodiment is illustrated in more detail in FIG. 5. The sensor 61 is fixed to the frame 42 of the assembly apparatus 13, adjacent the path of either the top or bottom planar surfaces of the spring interior 20. The sensor 61 is preferably adjustably mounted to the frame 42, longitudinally, transversely and vertically. The sensor 61 includes a stationary mounting bracket 63, which is fixed to the frame 42, an actuator lever 64 pivotally mounted to the bracket 63 on a pivot shaft 66 that is rotatable in the bracket 63, and a switch actuator 65 that is responsive to the angular position of the shaft 66 relative to the bracket 63. The switch actuator 65 may be a simple contact switch that can be angularly adjusted to close at a particular angular position of the shaft 66, or, preferably, is an angular optical encoder that outputs a signal indicative of the precise angular position of the shaft 66, which is then compared to a calibrated threshold value in the processor to produce the binary signal representing the "stretch" or "no-stretch" conditions.

In accordance with the present invention, a length adjustment mechanism 70 is provided to deform at least one section the measured portion of the spring interior 20 being formed whenever the measurement indicates that a length adjustment is needed to correct for a deviation in the measured length from the desired length D. In the embodiment where only a "stretch" or "no-stretch" condition is detected and output by the processor, the length adjustment mechanism 70 need only stretch the spring interior 20. In this first embodiment, spring coil bands 12 can be provided having sections that tend to be shorter than the desired section length B. Thus, adjustment of the length can then be provided only to stretch or lengthen the bridging sections 19 of the bands 12. Accordingly, when a measurement indicates that the measured portion of the spring interior 20 is sufficiently long, no adjustment will be made.

Figure 6:
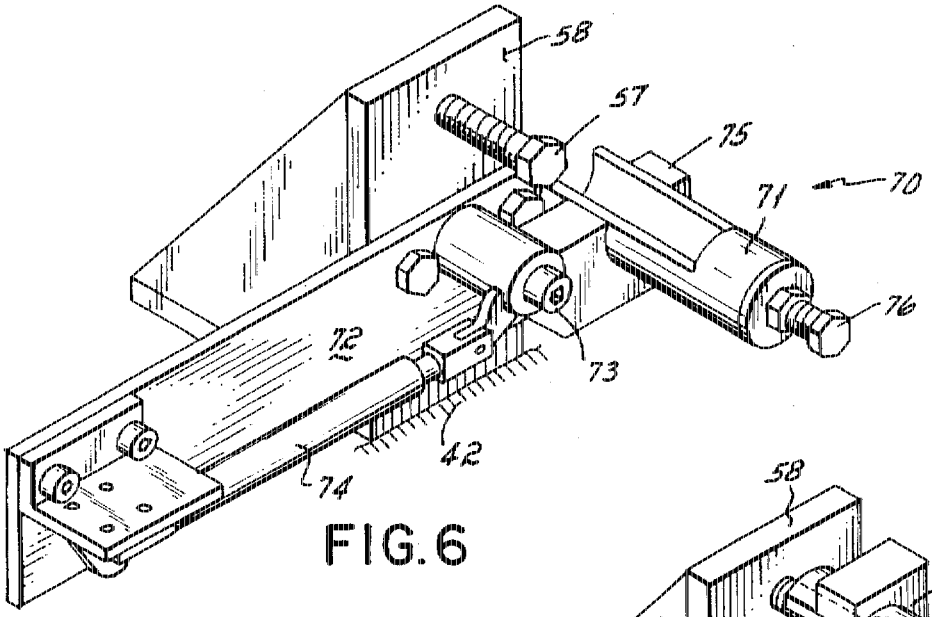
FIG. 6 is an isometric view of the of the moveable stop mechanism of the apparatus of FIG. 2 illustrated in the position for a band feed stroke of the advancing mechanism.
Figure 6A:
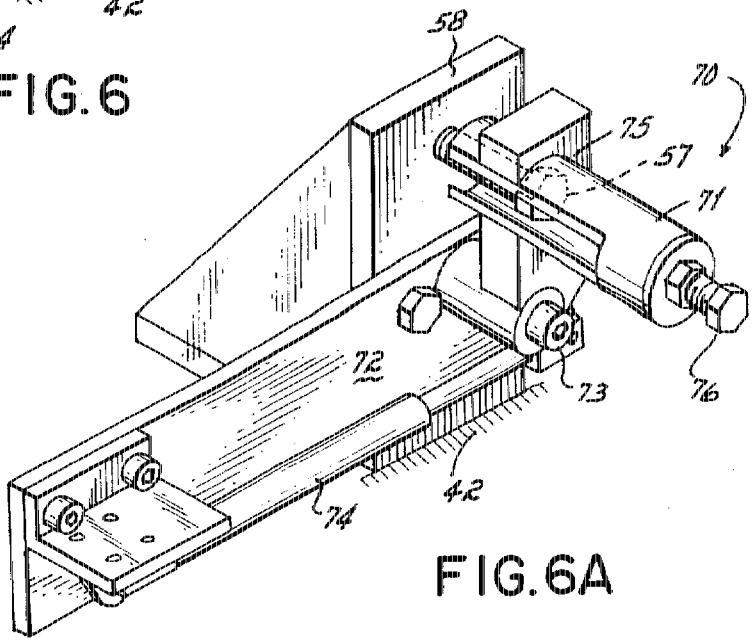
FIG. 6A is an isometric view of the of the moveable stop mechanism of the apparatus of FIG. 2 illustrated in the position for a band length adjusting stroke of the advancing mechanism.
Figure 9:
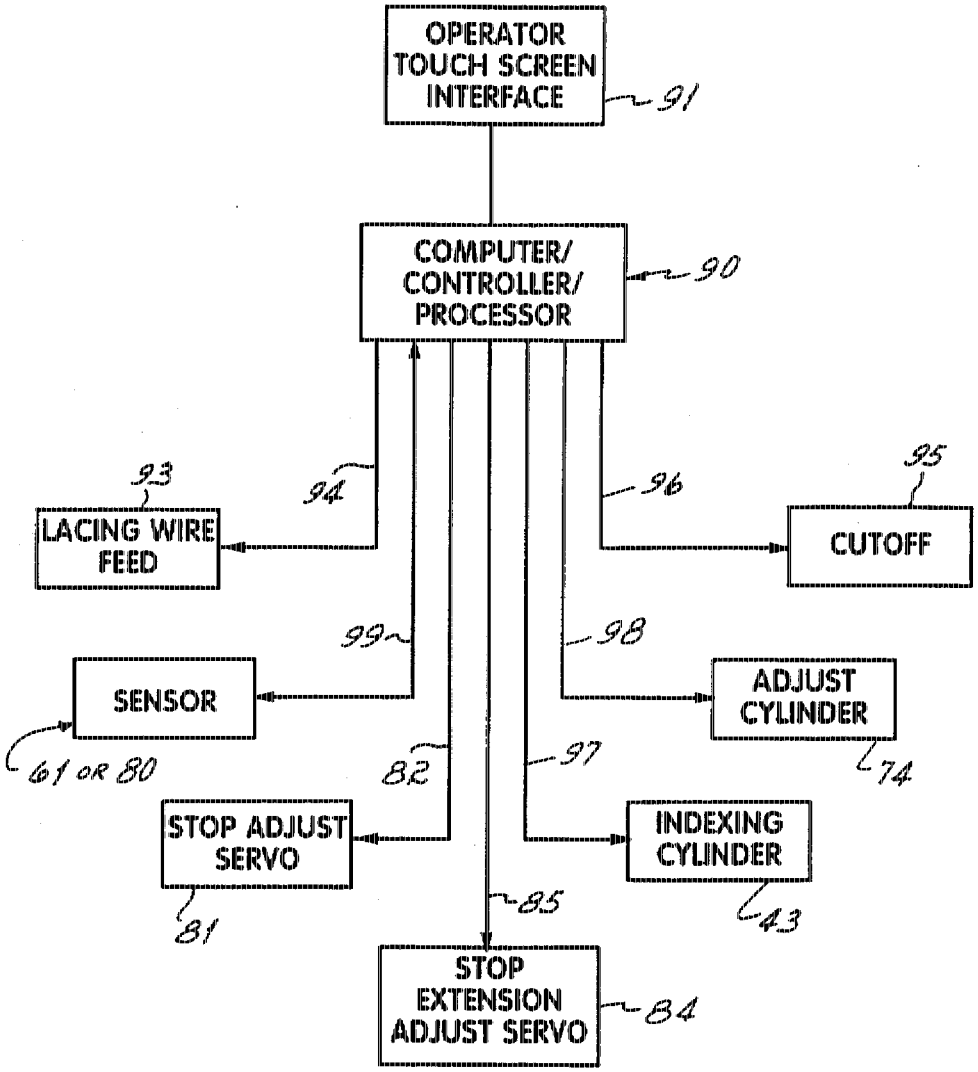
FIG. 9 is a diagram of the control portion of the system of FIG. 1.

In the first embodiment of the invention, the length adjustment mechanism 70 utilizes elements of the indexing mechanism 40, particularly the cylinder 43, the feeding block 46 as well as the related components 44, 46, 47 and 48. In addition, the length adjustment mechanism is provided with a selectable stop mechanism 71 and control signal overrides, preferably programmed into the processor of the controller of the apparatus 13, to maintain the locking, and prevent the release of, the moveable clamping dies 24. The selectable stop mechanism 71 is normally in the deactuated position, as illustrated in FIG. 3 and in detail in FIG. 6. Referring to FIG. 6, the stop mechanism 71 includes a support plate 72 fixed to the stop bracket 58 that supports the stop 57 of the indexing mechanism 40. Pivotally mounted to the plate 72 on a fixed shaft 73 is a length adjustment registration element 75 that carries a stop extension member 76 longitudinally adjustably mounted on the upstream end thereof. The registration element 75 is moveable between a rest position, as illustrated in FIG. 6, and an operative position, as illustrated in FIG. 6A, by a pneumatic cylinder 74, connected between the plate 72 and the registration element 75 to pivot the registration element 75 around the shaft 73. In the rest position, the registration element is out of the path of the bracket 45, so that the bracket 45 on the feed block 46 registers against the stop 57 in an indexing operation of the indexing mechanism 40. In its operative position, the registration element 75 functions as an extension of the stop 57, allowing the length adjustment mechanism to use components of the indexing mechanism 40.

Figure 4:
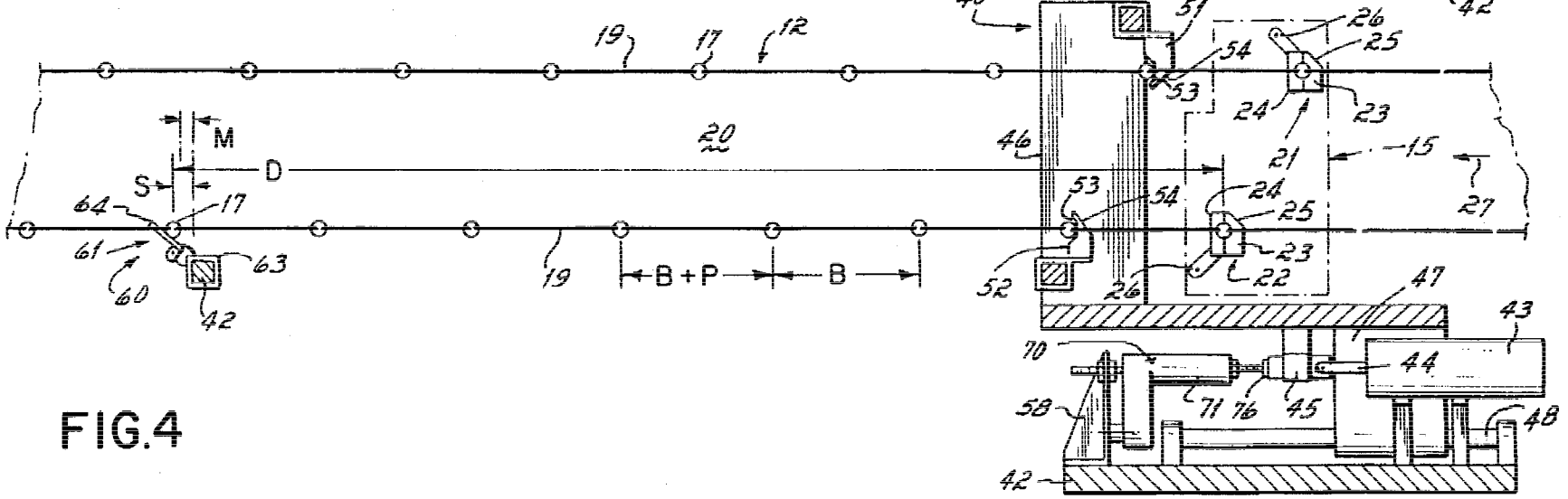
FIG. 4 is an elevational view, similar to FIG. 3, showing the spring interior assembly in a stretched condition.

In the operation of this embodiment of the adjustment mechanism 70, when it is determined that it is not necessary to stretch the assembly 20, the stop mechanism 71 is not actuated and remains in the position illustrated in FIGS. 3 and 6. The die sets 21,22 are opened by movement of the moveable dies 24 out of the planes of the upper and lower surfaces of the spring interior 20, and the indexing mechanism 40 is then operated in its normal cycle, advancing the spring interior 20 and bands 12 a distance approximately equal to one nominal section length B downstream in the assembly apparatus 13. When, however, it is determined that it is necessary to stretch the assembly 20, the die sets 21,22 remain closed, and the stop mechanism 71 is actuated and moved to the position illustrated in FIGS. 4 and 6A. Then the indexing mechanism 40 is operated through a cycle, which moves the upper and lower feed elements 51 and 52 downstream a fixed distance S determined by the spacing between the stop extension member 76 and the upstream position of the bracket 45 on the feed plate 46, illustrated in FIG. 4. This advances the portion of the spring interior 20 that is downstream of the lacing station 15 a distance S while holding fixed the lacing wire 17 and portions of the bands 12 that are at and upstream of the lacing station 15. This stretches, elastically and plastically, the bridging sections 19 an amount S between the die sets 21,22 at the lacing station 15 and the feed elements 51,52. When the cylinder 43 is withdrawn, the feed elements 51,52 also retract to their upstream positions (FIG. 3), whereupon the elastic deformation of the bridging elements 19 generally relaxes leaving the bridging elements 19 permanently deformed and lengthened by an amount P that is somewhat less than the original stretch distance S.

The original or total stretch distance S is preset to exceed the amount of permanent stretch desired. This setting may be enough to completely correct for the shortage measurement M in one stretch cycle or may be set to correct a lesser amount, requiring a series of sections to be corrected before the error M is eliminated. The distance S is, however, sufficiently large to insure that the permanent correction P is greater than the maximum average error component due to any given bridging section 19. When the length adjusting mechanism 70 has completed its cycle, the registration element 71 is lowered by reverse action of the cylinder 74 from the position of FIGS. 4 and 6A to the positions of FIGS. 3 and 6. Then, the indexing mechanism 40 is operated though a cycle as described above to advance the spring interior 20 and bands 12 one nominal section length B. By selectively stretching or not stretching a section by the given amount S, some sections of the spring interior 20 will have the nominal unstretched approximate length B while others will have the nominal stretched approximate length B+P.

Figure 7:
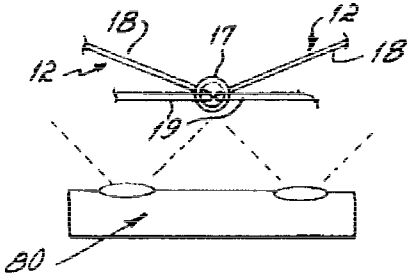
FIG. 7 is a diagram illustrating an alternative length sensor to that of FIG. 5.

In its alternative embodiments, the output of the sensor 61 or an alternative sensing or measuring device, can be in the form of a digital or analog value representing the exact length of the portion of the spring interior 20 from the die sets at the lacing station 15 to the lacing wire 17 at the measuring station 40. The sensor 61 is preferably in the form of an angular encoder 65 located on the shaft 66 of the lever 64. The encoder output is resolved by the processor of the controller into a horizontal longitudinal position measurement representative of the distance from the lacing station of the lacing wire 17 that is in contact with the lever 64. The sensor 61 may also be in the form of an optical resolver 80 or other non-contact sensor as illustrated in FIG. 7. The optical resolver 80 may produce a stereo image that can be interpreted by a processor within it or a computer associated with the controller of the system 10. Such a resolver will identify and may determine the longitudinal position of a lacing wire 17 relative to the lacing station or may produce some other output from which a length measurement of at least a portion of the spring interior 20 may be determined.

Figure 8:
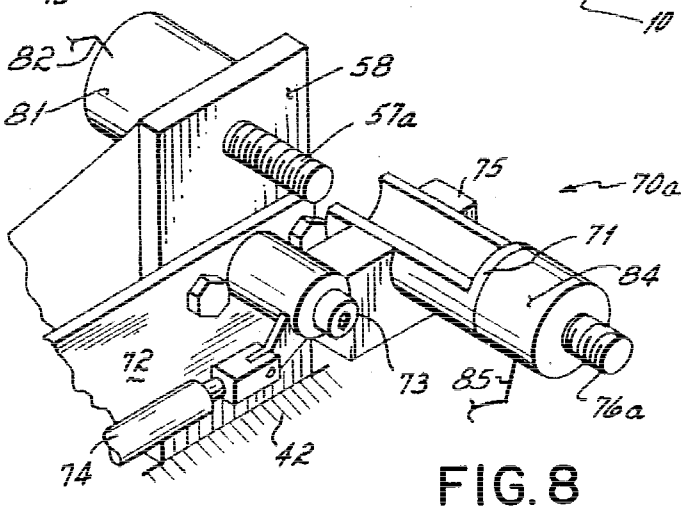
FIG. 8 is an isometric view, similar to FIG. 6, of an alternative stop and stop extension of the variable or automatically adjustable type.

In alternative embodiments to that described above, the stop 57 or the stop extension member 76 or both may be provided with automatic adjustment capability, as, for example the stop **57*a* and stop extension member 76*a* illustrated in FIG. 8. Such a stop 57*a* may be in the form of an extendable screw shaft that is driven inward or outward of the bracket 58 by the controlled operation of a servo or stepper motor 81 responsive to control signals on signal line 82 from an output of the system controller. Similarly, the stop extension member 76*a* may also be in the form of an extendable screw shaft that is driven inward or outward of the registration element 75 by the controlled operation of a servo or stepper motor 84 that may be similarly responsive to control signals on a signal line 85** from an output of the system controller.

The operator will communicate with the controller, computer or other control processor 90 of the system 10 through an interface such as a touch screen control panel and display 91. The control panel 91 contains button images to accept from an operator commands to start and stop the assembly machine 13 and to perform adjustments such as to advance or retract the settings of the stop 57*a* and stop extension 76*a* by selectively driving or stepping the motors 81 or 84. When the machine 13 is started and running through its operating cycles, the controller 90 sends periodic control signals to a lacing wire feed motor 93 at the lacing station 15 through an output signal line 94, to a cutoff mechanism 95 at the cutoff station 30 through an output signal line 96, and to the cylinders 43 and 74 through respective output signal lines 97 and 98 in response to input signals received from the sensor 61,80 on input signal line 99, to perform the operational sequences described throughout the description above. Where the output of the sensor is, or is reduced to, a binary bit of information, the controller need be no more than a logic circuit which evaluates a binary bit or switch status from the sensor that initiates a stretch cycle in response to one binary value of the input signal from the sensor followed by initiation of an indexing cycle, or that bypasses the stretch cycle and initiates only an indexing cycle.

The provision of controlled stop adjustments presents the advantages of optimizing the operation of the assembly apparatus 13 and the dimensions of the produced spring interior units 20, particularly when combined with a sensor 80 that is capable of determining the magnitude of any deviation in measured length from a desired length, and particularly where the processor 90 is provided with memory and is programmed to store in the memory and analyze successive error measurements. For example, where the adjustment mechanism 70 has only the capability of stretching the spring interior 20, consecutive determinations to stretch spring interior sections coupled with continuously increasing errors suggests that the amount of correction or stretch length S is insufficient and should be increased. In such a case, the controller 90 will automatically send a signal on line 85 to the stop extension adjustment servo or stepper motor 84 to energize the motor to retract, or move further downstream, the extension stop 76*a*, thereby increasing the length of the adjustment or stretching stroke. The controller 90 evaluates a series of measurements, predict trends in the error measurements M, and adjust the stretch S such that the correction is evenly distributed over all of the bridging sections 19. Alternatively, the correction may be such that the number of stretch cycles are minimized, or are distributed to optimally correct the overall spring interior length between cutting points so that the lengths of the cut spring interiors 28 are optimized.

Further, it may be desirable to reduce variations in the lengths of the bridging sections 19 caused by extensive stretching of some sections and no stretching of others. In such a case, the controller 90 can determine that such a condition exists from the length of the stretching stroke and data on the material properties of the wire of which the bands 12 are made, and can shorten the stretching adjustment stroke by automatically sending a signal on line 85 to the motor 84 to cause the motor 84 to extend the extension stop 76*a* to decrease the length of the stretching stroke. The change can be such that it tends to cause all of the bridging sections 19 to be stretched by the same amount. It might also be desirable to distribute the stretching at least at frequent enough intervals to insure that correction is not made to spring interior unit while most of the measured error lies on the previously cutoff unit. This can be provided by the processor appropriately distributing the length adjustments among the bridging sections 19.

Alternatively, variations in the lengths of the bridging sections 19 caused by extensive stretching of some sections and no stretching of others may be within tolerable limits, while the frequent stretching of the bridging sections may be unduly slowing the production. In such a case, the controller 90 can determine from the length of the stretching stroke and data on the material properties of the wire of which the bands 12 are made that fewer stretch cycles providing longer stretch strokes are possible, which will increase the productivity of the equipment. Thus, by automatically sending a signal on line 83 to the motor 85 to cause the motor 85 to retract the extension stop 76*a* to increase the length of the stretching stroke, thereby eliminating the need to stretch other bridging sections.

Furthermore, while it is described above as preferred that all of the length adjustments take place as a stretching action, compression adjustments can also be made. For example, the feed elements 51,52 can be provided in the form of die sets similar to die sets 21,22, and the indexing cylinder 43 can be modified, or an additional cylinder provided, to give the capability of selectively retracting the plate 46 in the upstream direction to compress the bridging element rather than stretch it. With such an embodiment, it might be advantageous to provide upper and lower guides that constrain the upper and lower bridging elements to prevent buckling during compression.

With many of the embodiments, it is preferable that the controller be programmable and include a microprocessor, or that it include or be linked to a digital computer programmed to evaluate the signal from the sensor and any stored data, compare the measured or sensed information against stored or programmed criteria or algorithms and then generates output signals to initiate corrective action that is indicated as a result of a computerized evaluation of the input information from the sensor.

From the above detailed description of the details of the illustrated embodiments of the invention, it will be apparent to those skilled in the art that various modifications and additions may be made thereto without departing from the principles of the present invention.

Therefore, the following is claimed:

1. A method of manufacturing spring interiors by feeding a transversely spaced plurality of longitudinal columns of spring coils longitudinally through a lacing station and transversely lacing the columns together at the lacing station as the columns are fed therethrough to form a spring interior of transversely laced and longitudinally interconnected columns of spring coils, the method comprising the steps of:

sensing a length of at least a portion the formed spring interior downstream of the lacing station and inputing to a controller an input signal carrying information of the sensed length;

evaluating the sensed length information with the controller in response to the input signal and generating a correction signal based on the results of the evaluation; and engaging the columns with an adjusting mechanism and driving the adjusting mechanism in response to the correction signal to deform the longitudinally interconnected columns and thereby change the length of the interconnected columns in accordance with the results of the evaluation.

2. The method of claim 1 wherein:

the sensing step includes the step of generating the input signal to carry information indicating whether or not the length of the portion of the formed spring interior downstream of the lacing station at least equals a minimum length; and the length evaluating and correction signal generating step includes the step of actuating the adjusting mechanism to stretch the engaged columns when the sensed length does not at least equal the minimum length.

3. The method of claim 2 wherein:

the length evaluating and correction signal generating step further includes the step of bypassing the actuation of the adjusting mechanism when the sensed length exceeds the minimum length.

4. The method of claim 1 wherein:

the information carried by the input signal includes a value related to the sensed length of the portion of the spring interior;

the evaluating and correcting signal generating step includes the step of determining the amount to deform the longitudinally interconnected columns based on the value of the sensed length; and the column engaging and adjustment mechanism driving step includes the step of driving the adjustment mechanism to change the length of the interconnected columns by the determined amount.

5. The method of claim 4 wherein:

the length evaluating and correction signal generating step includes the step of actuating the adjusting mechanism to stretch the engaged columns to lengthen the interconnected columns by the determined amount.

6. The method of claim 1 wherein:

the evaluating and correcting signal generating step includes the step of storing in a memory information relating to the results of the calculation;

the column engaging and adjustment mechanism driving step includes the step of driving the adjustment mechanism to change the length of the interconnected columns by a determined amount; and the method further comprises the steps of analyzing with the processor information stored in the memory during each of a plurality of cycles of the machine and establishing the determined amount based on the results of the analysis.

7. The method of claim 1 wherein:

the lacing station includes a set of dies operable to selectively grip or release the columns extending therethrough and wherein an indexing mechanism is provided to advance the columns through the lacing station with the columns released by the dies; and the adjustment mechanism driving step includes the step of operating at least a portion of the indexing mechanism with the columns gripped by the dies to change the length of the bands.

8. The method of any of claims 1 through 7 further comprising the step of providing the longitudinal columns of spring coils such that each of the columns is a band that includes an alternating series of the coils and interconnecting bridging sections formed of a single piece of wire, and wherein the column engaging step includes the step of engaging the bands with an adjusting mechanism and driving the adjusting mechanism in response to the correction signal to deform the bands and thereby change the length of the bands in accordance with the results of the evaluation.

9. An apparatus for assembling spring interiors from a plurality of continuous longitudinally extending and interconnected transversely laced columns of spring coils and shaped into a series of similar patterns, the apparatus comprising:

a longitudinal feed mechanism;

a lacing station;

a measuring station spaced longitudinally downstream of the lacing station;

a detector located at the measuring station and operative to generate a measurement signal in response to the detection of a pattern at the measuring station; and a processor programmed to:

determine, in response to the measurement signal, a longitudinal length condition of the spring interior being assembled in the apparatus, evaluate the determined length condition in relation to a desired length, and generate an output signal in accordance with the evaluation;

at least one pair of adjusting elements configured to engage at least one of the longitudinally interconnected columns at two points thereon; and an adjustment mechanism operative to move at least one element of a pair in response to the output signal so as to change the length the interconnected columns by an amount based on the evaluation.

10. The apparatus of claim 9 wherein the processor is programmed to:

determine the length condition by calculating, in response to the measurement signal, a longitudinal length of the spring interior being assembled in the apparatus; and evaluate the difference by calculating the difference between the calculated length and the desired length.

11. The apparatus of claim 10 wherein:

the adjusting elements include a set of dies configured to grip the columns at two points and deform the longitudinally interconnected columns longitudinally by the amount of the calculated difference; and the adjustment mechanism includes means for moving the dies relative to each other a distance based on the calculated difference.

12. The apparatus of claim 10 wherein:

the processor includes program means including:

means for periodically receiving the measurement signal and determining therefrom the cumulative length of the spring interior as each pattern is fed past the lacing station; and means for generating the output signal in response to each of the cumulative length determinations to successively operate the adjustment mechanism to progressively adjust the length of the interconnected.

13. The apparatus of claim 12 wherein:

the output signal is generated as a predetermined function of the calculated difference; and the output signal generating means includes:

means for modifying the predetermined function with each successive operation of the adjusting means.

14. The apparatus of any of claims 10 through 13 wherein:

each column is formed of a plurality of spring coils joined by bridging segments.

15. A spring interior assembly apparatus comprising:

means for longitudinally feeding into the apparatus a plurality of columns of spring coils;

means for transversely lacing corresponding patterns of the columns together;

means downstream of the lacing means for measuring the longitudinal length of the spring interior being assembled in the apparatus, for calculating the difference between the measured length and a desired length, and for generating an output signal in accordance with the calculated difference; and means responsive to the output signal for adjusting the lengths of the columns by an amount based on the calculated difference.

16. The apparatus of claim 15 wherein:

the adjusting means includes a set of dies for gripping the columns at two points therealong and deforming the bands longitudinally by the amount of the calculated difference.

17. The apparatus of claim 15 wherein:

the measuring, calculating and generating means includes:

means for periodically measuring the cumulative length of the spring interior as each pattern is fed past the lacing means; and means for generating the output signal in response to each of the periodic measurements by the measuring means to successively operate the adjusting means to progressively adjust the length of the columns.

18. The apparatus of claim 17 wherein:

the output signal is generated as a predetermined function of the calculated difference; and the output signal generating means includes:

means for modifying the predetermined function with each successive operation of the adjusting means.

19. The apparatus of any of claims 15 through 18 wherein:

the feeding means includes means for longitudinally feeding into the apparatus a plurality of continuous spring bands formed of a series of similar patterns of spring coils and bridging segments; and the lacing means includes means for transversely lacing corresponding patterns of the bands together.

* * * * *